US012765663B2

(12) United States Patent
Parrilli

(10) Patent No.: US 12,765,663 B2
(45) Date of Patent: Oct. 20, 2026

(54) FLUID DELIVERY BRUSH TIP SYSTEM

(71) Applicant: Dellamarie Parrilli, Los Angeles, CA (US)

(72) Inventor: Dellamarie Parrilli, Los Angeles, CA (US)

( * ) Notice: Subject to any disclaimer, the term of this patent is extended or adjusted under 35 U.S.C. 154(b) by 0 days.

(21) Appl. No.: 19/171,720

(22) Filed: Apr. 7, 2025

(65) Prior Publication Data

US 2026/0305808 A1 Oct. 8, 2026

(51) Int. Cl.

| | |
|---|---|
| ***A46B 11/00*** | (2006.01) |
| ***A46B 9/02*** | (2006.01) |
| ***A46B 9/04*** | (2006.01) |

(52) U.S. Cl.

CPC ..... *A46B 11/0041* (2013.01); *A46B 9/026* (2013.01); *A46B 9/04* (2013.01); *A46B 11/0079* (2013.01); *A46B 2200/108* (2013.01)

(58) Field of Classification Search

CPC ..... A46B 11/0041; A46B 9/026; A46B 9/04; A46B 2200/108; A46B 11/0079; A46B 11/0086

USPC ... 401/44–47, 183–186, 268, 283, 285, 286, 401/288

See application file for complete search history.

(56) References Cited

U.S. PATENT DOCUMENTS

| | | | | |
|---|---|---|---|---|
| 3,738,762 A * | 6/1973 | Moore | A46B 11/0041 | 401/184 |
| 4,199,270 A * | 4/1980 | Tomasini | A46B 15/00 | 401/277 |
| 5,186,559 A * | 2/1993 | Fu | A47G 19/183 | 401/47 |
| 5,307,954 A * | 5/1994 | Gick | B65D 1/04 | 401/35 |
| 5,908,257 A * | 6/1999 | Martin | A46B 11/0027 | 401/175 |
| 6,918,153 B2 * | 7/2005 | Gruber | A46B 11/066 | 601/162 |
| 8,979,410 B2 * | 3/2015 | Massimi | A46B 11/0041 | 401/185 |
| 2015/0033482 A1 * | 2/2015 | Miles | A46B 11/0041 | 15/104.94 |

* cited by examiner

*Primary Examiner* — David J Walczak
(74) *Attorney, Agent, or Firm* — Cohen IP Law Group P.C.; Michael N. Cohen

(57) ABSTRACT

A squeeze bottle with an integrated brush and squeeze zones. The squeeze bottle includes an elongate fluid output tip with an integrated brush. When squeezed, fluid may exit the tip through side wall openings to wet the brush bristles for use in cleaning (e.g., for interdental cleaning). The squeeze bottle also may include two or more internal fluid chambers and corresponding squeeze zones. The cross-sectional areas of the fluid chambers are different from one another such that when a particular squeeze zone that corresponds to a particular internal fluid chamber is squeezed, the resulting fluid output from the squeeze bottle includes a unique velocity that depends, at least in part, on the dimensions of the fluid chamber being squeezed. The squeeze bottle fluid output tip also may include a drip-free canula.

15 Claims, 12 Drawing Sheets

FIG. 12
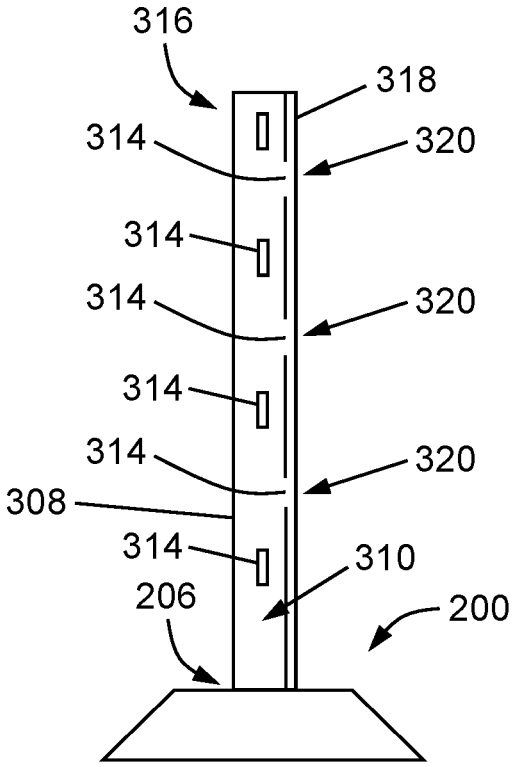
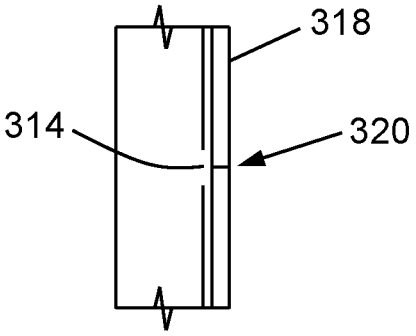
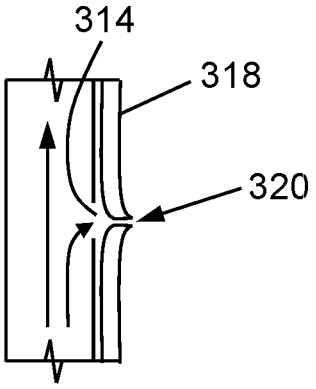
FIG. 13A FIG. 13B

FLUID DELIVERY BRUSH TIP SYSTEM

FIELD OF THE INVENTION

The field of the current invention regards containers, including a squeeze bottle with a brush and variable outputs.

BACKGROUND

Handheld squeeze bottles are used to administer fluids of all kinds for different purposes. For example, squeeze bottles may be used to administer cleaning fluids (e.g., for interdental cleaning), for administering fluid ingredients to mixtures, and for other purposes.

Such squeeze bottles typically include an output fluid nozzle adapted to deliver fluid outputs, e.g., fluid streams, at a single fluid velocity. That is, the bottle is squeezed, and fluid is caused to exit the bottle out the bottle nozzle at a particular fluid velocity given the dimensions of the bottle and nozzle.

However, such squeeze bottles do not include brushes configured with the output fluid nozzles that may be used in conjunction with the fluid outputs (e.g., for interdental cleaning). In addition, such squeeze bottles also do not enable the user to easily choose between different output fluid velocities without the use of complicated adjustable nozzles that may be difficult to adjust.

Accordingly, there is a need for a squeeze bottle that includes a fluid output tip comprising an integrated brush. There also is a need for a squeeze bottle that provides different fluid output velocities that are easy to choose from and implement.

BRIEF DESCRIPTION OF THE DRAWINGS

While this invention may be embodied in many different forms, there are described in detail herein specific embodiments of the invention. This description is an exemplification of the principles of the invention and is not intended to limit the invention to the particular embodiments illustrated.

Various other objects, features and attendant advantages of the present invention will become fully appreciated as the same becomes better understood when considered in conjunction with the accompanying drawings, in which like reference characters designate the same or similar parts throughout the several views, and wherein:

FIG. 12 shows a side view of a canula according to exemplary embodiments hereof; and FIGS. 13A and 13B show aspects of a canula according to exemplary embodiments hereof.

DETAILED DESCRIPTION OF EXEMPLARY EMBODIMENTS

The current invention is now described with reference to the figures. In general, the squeeze bottle system includes a squeeze bottle including a fluid output tip. The fluid output tip may output fluid though a distal opening and/or through side openings positioned in the tip's outer circumferential surface along its length. In this way, the tip may provide 360° of fluid dispersion. The tip also may include an integrated brush that may be used in conjunction with the output fluid streams such that the tip comprises a fluid dispensing brush tip. Additionally, the squeeze bottle may output fluid at varying velocities depending on where the bottle may be squeezed along its body. The squeeze bottle system also may include other elements and benefits as described herein.

Figure 1:
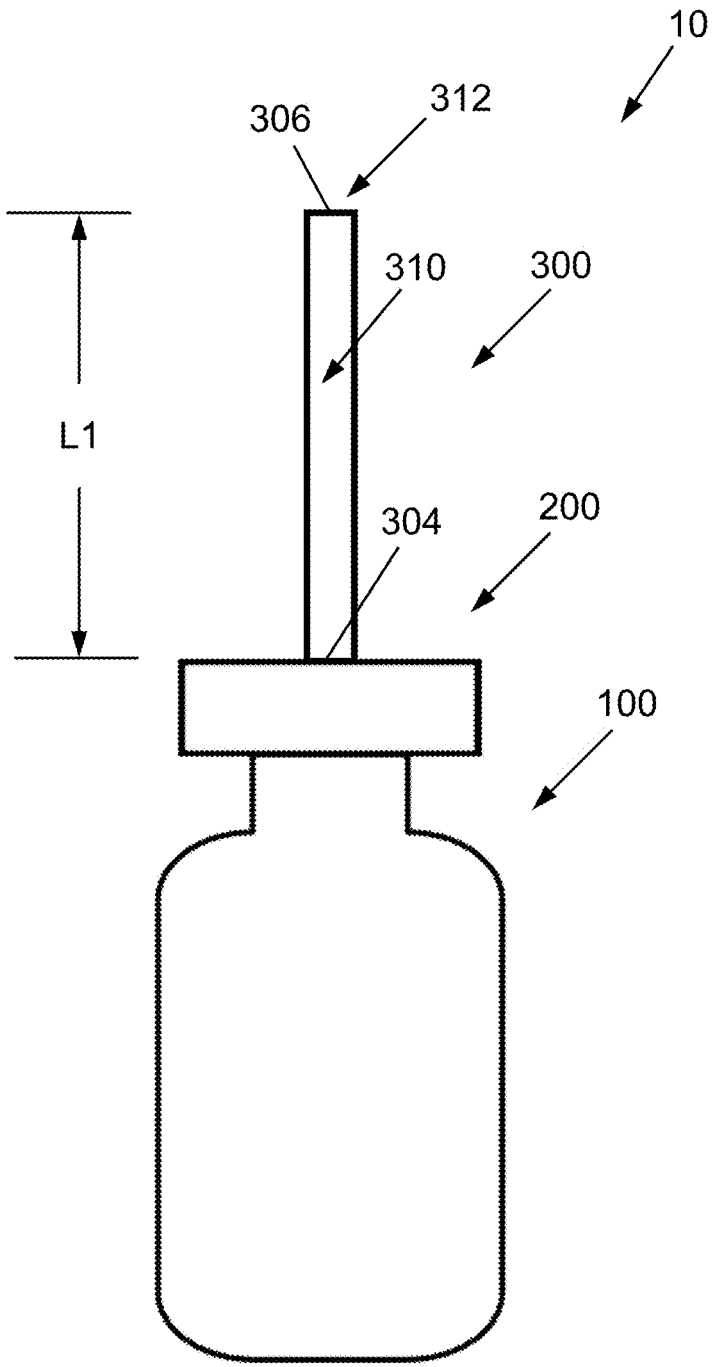
FIG. 1 shows a side view block diagram of a squeeze bottle system according to exemplary embodiments hereof.

FIG. 1 shows a side view block diagram of a squeeze bottle system 10 (also referred to herein as simply the system 10) including a bottle assembly 100, a fluid output assembly 200, and a tip assembly 300. The bottle assembly 100 may comprise a flexible material (e.g., high-density polyethylene, low-density polyethylene, polypropylene, and/or other suitable materials) and may be filled with a fluid (e.g., a dental hygiene cleaning solution, a saline solution, etc.). The fluid output assembly 200 may provide an interface between the bottle assembly 100 and the tip assembly 300 such that when the bottle assembly 100 is squeezed, a desired amount and form of fluid is output via the tip assembly 300. In some embodiments, the tip assembly 300 may include an integrated brush 400 (e.g., an interdental brush). The system 10 also may include other elements and components as necessary to fulfill its functionalities.

In some embodiments, as shown in FIG. 1, the tip assembly 300 may include a tip member 302 including a proximal end 304 generally configured with the fluid output assembly 200, a distal end 306 generally opposite the proximal end 304, and a body with an outer circumferential surface 308 extending between the proximal end 304 and the distal end 306 thereby defining a generally hollow inner volume 310. The tip member 302 may preferably be elongate and tubular with a suitable cross-sectional shape (e.g., circular, oval shaped, rectangular, square, triangular, other polygonal shapes, etc.). In some embodiments, the length L1 of the tip member 302 may be about 0.25" to about 5", and preferably about 0.5" to about 4", and more preferably about 1" to about 3", and more preferably about 1.5" to about 2.5", and more preferably about 2".

In some embodiments, the tip member 302 includes a fluid output port 312 at or near its distal end 306 such that when the squeeze bottle 100 is squeezed, fluid may be forced out of the tip's distal output port 312 at a desired velocity and form factor (e.g., a stream, a mist, a dispersion, a laminar stream, a bloom, etc.).

Figure 2:
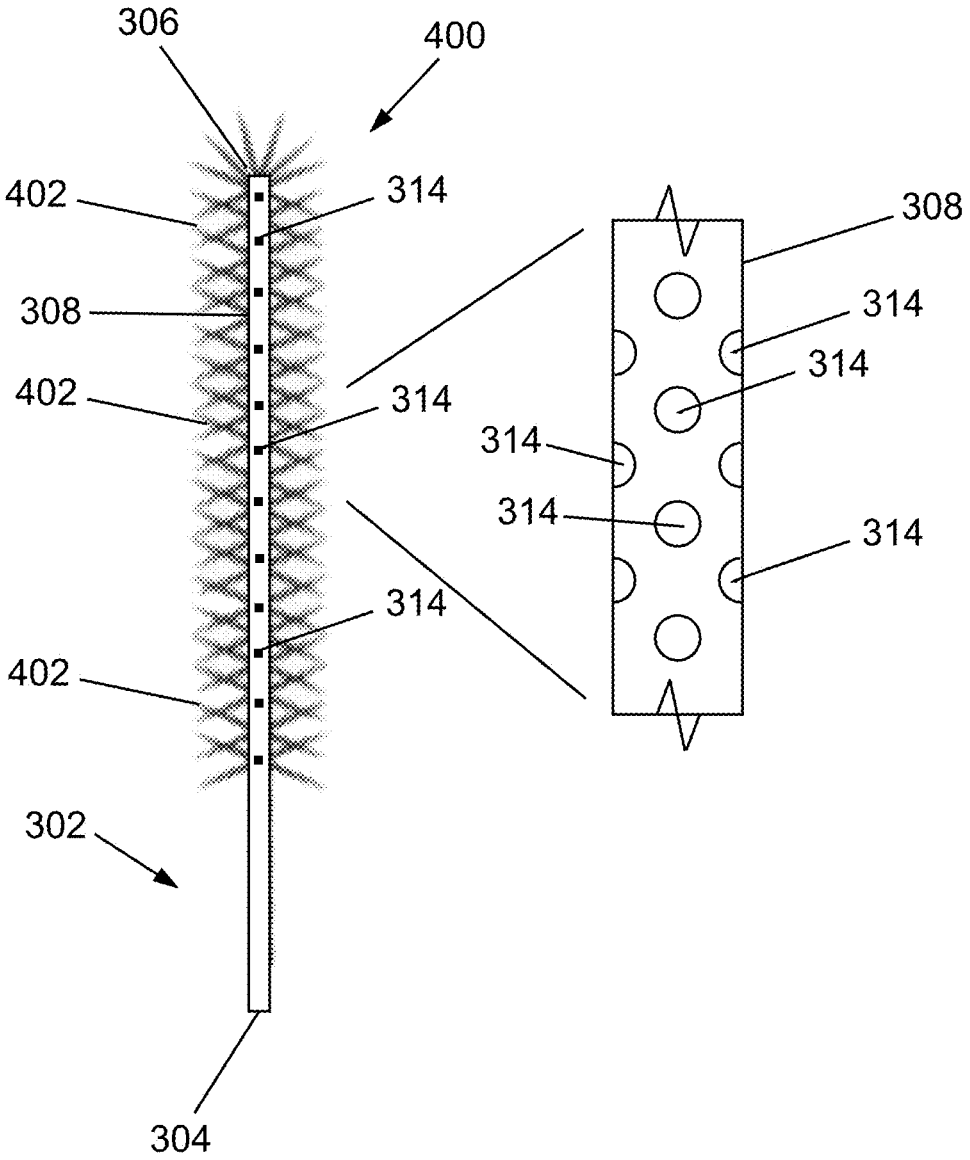
FIG. 2 shows a side view and a close-up view of a tip member including a brush according to exemplary embodiments hereof.

FIG. 2 shows a tip member 302 integrated with a brush 400, and a close-up view of the tip member 302 showing details of its side openings 314. The brush 400 has been omitted in the close-up view for clarity.

In some embodiments, as shown in FIG. 2, the tip member 302 includes an integrated brush 400. The integrated brush 400 may include one or more brush bristles 402 coupled to and extending away from at least a portion of the tip member's outer circumferential surface 308. The bristles 402 preferably cover the entire outer circumference of the tip member in the area of the brush 400. The bristles 402 may comprise natural materials and/or synthetic materials such as plastic, silicone, nylon, and/or other suitable materials.

In some embodiments, the tip member 302 includes one or more outer circumferential openings 314 (also referred to herein as the side openings 314) through which the fluid may exit the tip member 302 when fluid under pressure passes through the tip member's inner volume 310, e.g., from the bottle 100 via the fluid output assembly 200.

In some embodiments, as shown in the close-up view of FIG. 2, the side openings 314 are located along at least a portion the length L1 of the tip member 302. In some embodiments, the side openings 314 may be arranged in a periodic pattern along the sides 308 of the tip member 302 to provide a full 360° output coverage of the fluid output streams through the openings 314. In other embodiments, the side openings 314 may be arranged randomly, and/or in an arrangement that is partially periodic and partially random. In any event, it is preferable that the output fluid streams emitting from the aggregate side openings 314 provide a 360° dispersion of output fluid about the longitudinal axis of the tip member 302 in the area of the side openings 314. In some embodiments, the tip member 302 may include 2 or more side openings, and preferably 10 or more side openings 314, and more preferably 20 or more side openings 314, and more preferably 30 or more side openings 314, and more preferably 40 or more side openings 314. The diameter of the side openings 314 may preferably be about 1 mm-2 mm or less.

In some embodiments, the side openings 314 may be arranged within and/or between the brush bristles 402 such that fluid emitted out of the side openings 314 may adequately wet the bristles 402 and/or move past the bristles 402, e.g., into the user's mouth for use in interdental cleaning. In this way, the tip member 302 may comprise a fluid dispensing brush tip.

In some embodiments, the brush bristles 402 and/or the side openings 314 cover at least 25% of the length L1 of the tip 302, and preferably about 10% to about 90% of the length L1, and more preferably at least 50% of the length L1. While FIG. 2 shows the bristles 402 extending all the way to the distal end 306 of the tip member 302, it is understood that the bristles 402 may be located on any areas along the sides 308 of the tip 302 while leaving other areas of the sides 308 free of bristles 402.

During use, in one example, the bottle 100 may be filled with an interdental cleaning solution and the tip member 302 and its integrated brush 400 may be placed within a user's mouth. The user may then squeeze the bottle 100 thereby forcing the solution through the tip member 302 and out the tip's side openings 314. Some of the output solution may wet the bristles 402 and some of the output solution may move past the bristles 402 and into the area of the user's mouth to be cleaned. In this way, the user may direct the cleaning fluid to the desired area within his/her mouth while applying brush movements to facilitate optimal cleaning of the area (e.g., along the gums and/or in-between the teeth). It is understood that this example is meant for demonstration and that the system 10 may be used for other types of applications.

Figure 3:
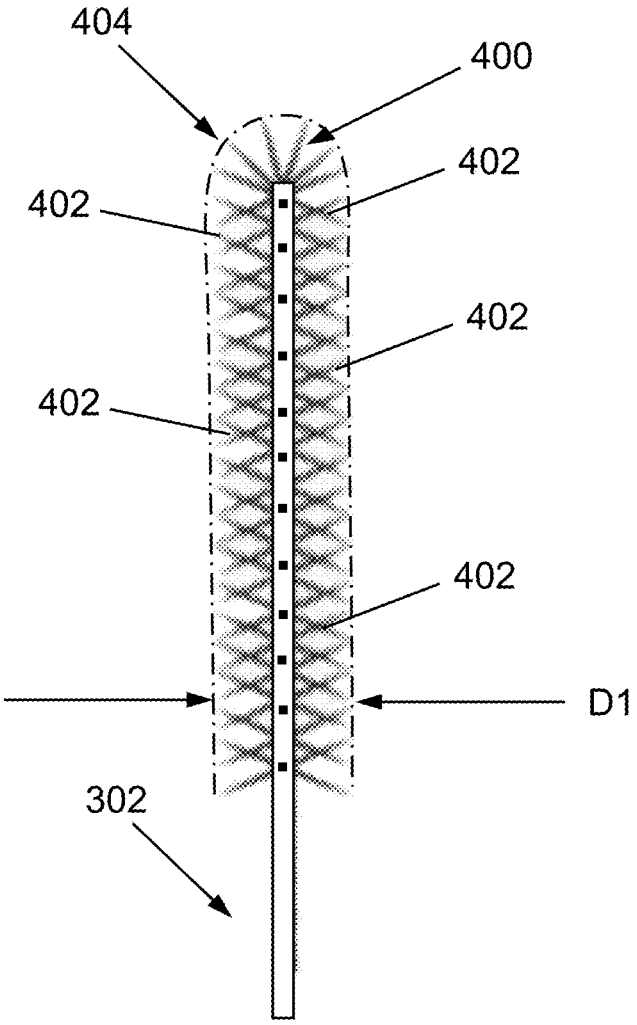
FIGS. 3-4 show aspects of a brush according to exemplary embodiments hereof.

FIG. 3 shows the tip member 302 and its integrated brush 400 with brush bristles 402 including a brush bristle outer profile 404. As shown in FIG. 3, the brush bristle outer profile 404 may generally include a constant diameter D1 of about 1 mm to about 10 mm and preferably a constant diameter D1 of about 1 mm to about 5 mm. In some embodiments, the bristle profile 404 may include a rounded end at the distal end 306 of the tip member 302 and it is understood that other shaped ends such as pointed or square also may be included.

Figure 4:
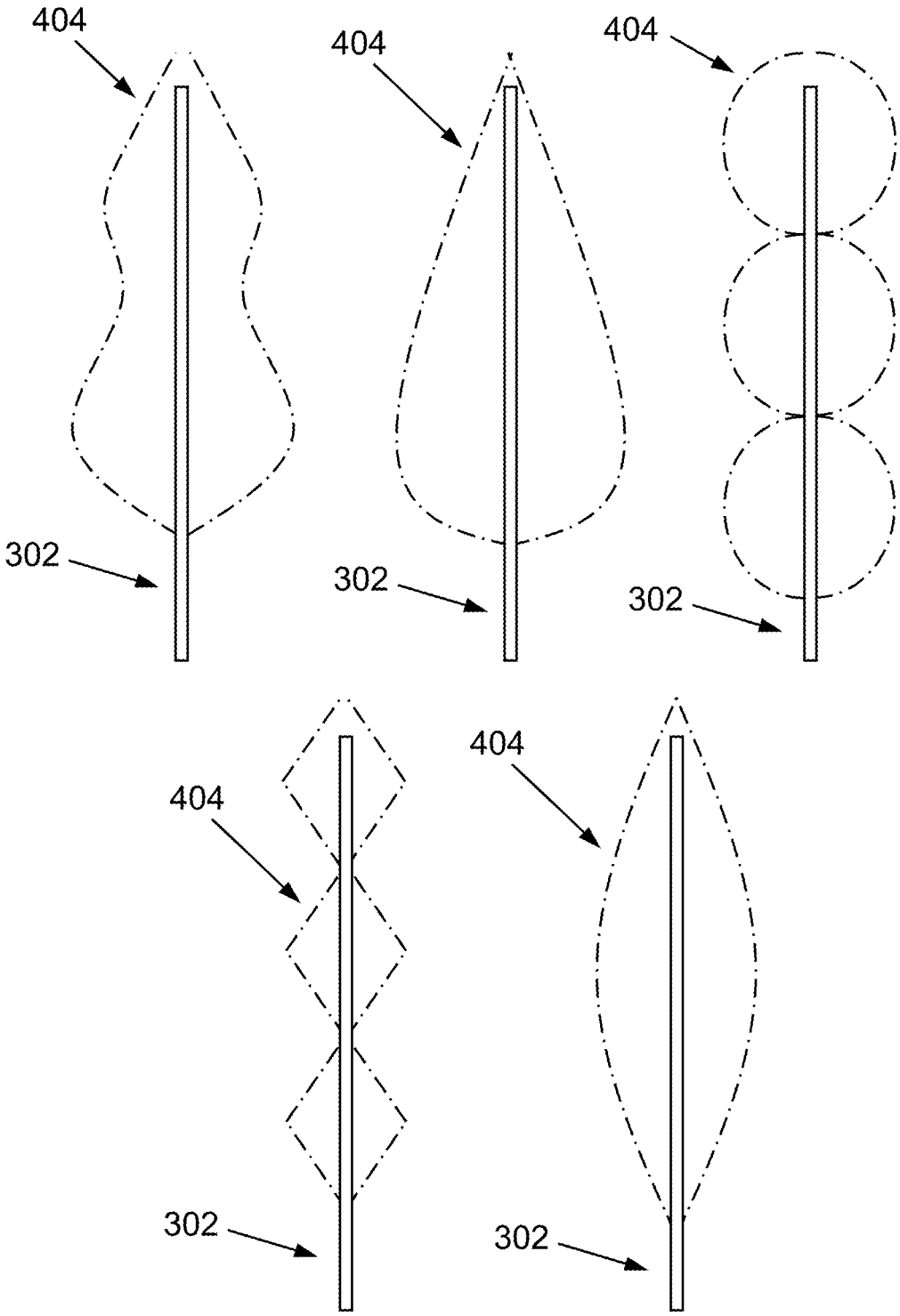

FIG. 4 shows other exemplary brush bristle profiles 404 including (from the upper left example clockwise to the lower left example): a lower convex curvature and an upper convex curvature with an intermediary concave curvature therebetween, the upper and lower convex curvatures having equal and/or differing diameters both of which may be greater than the diameter of the concave curvature, a lower convex curvature tapering to a point at the tip's distal end 306, a sequential series of semi-circular (or convex) curvatures, a single convex curvature tapered to a point at both ends, and a sequential series of triangular (e.g., zig-zag) curvatures. It is understood that these bristle profiles 404 are meant for demonstration and that the bristles 402 may include other suitable profiles, e.g., depending on the application of the brush 400 and of the overall squeeze bottle system 10.

Aspects of the bottle assembly 100 and of the fluid output assembly 200 will be described next. It is understood that these aspects may be independent of the aspects of the tip assembly 300 and of the integrated brush 400. It also is understood that the tip assembly 300 and/or the brush 400 may be utilized with the embodiments of the squeeze bottles 100 described herein, as well as with other types of containers not necessarily described. Similarly, it is understood that the bottle assembly 100 and/or the fluid output assembly 200 may be used with the tip assembly 300 and/or with the brush 400 as described herein, and/or with other tips and/or with other brushes.

Figure 5:
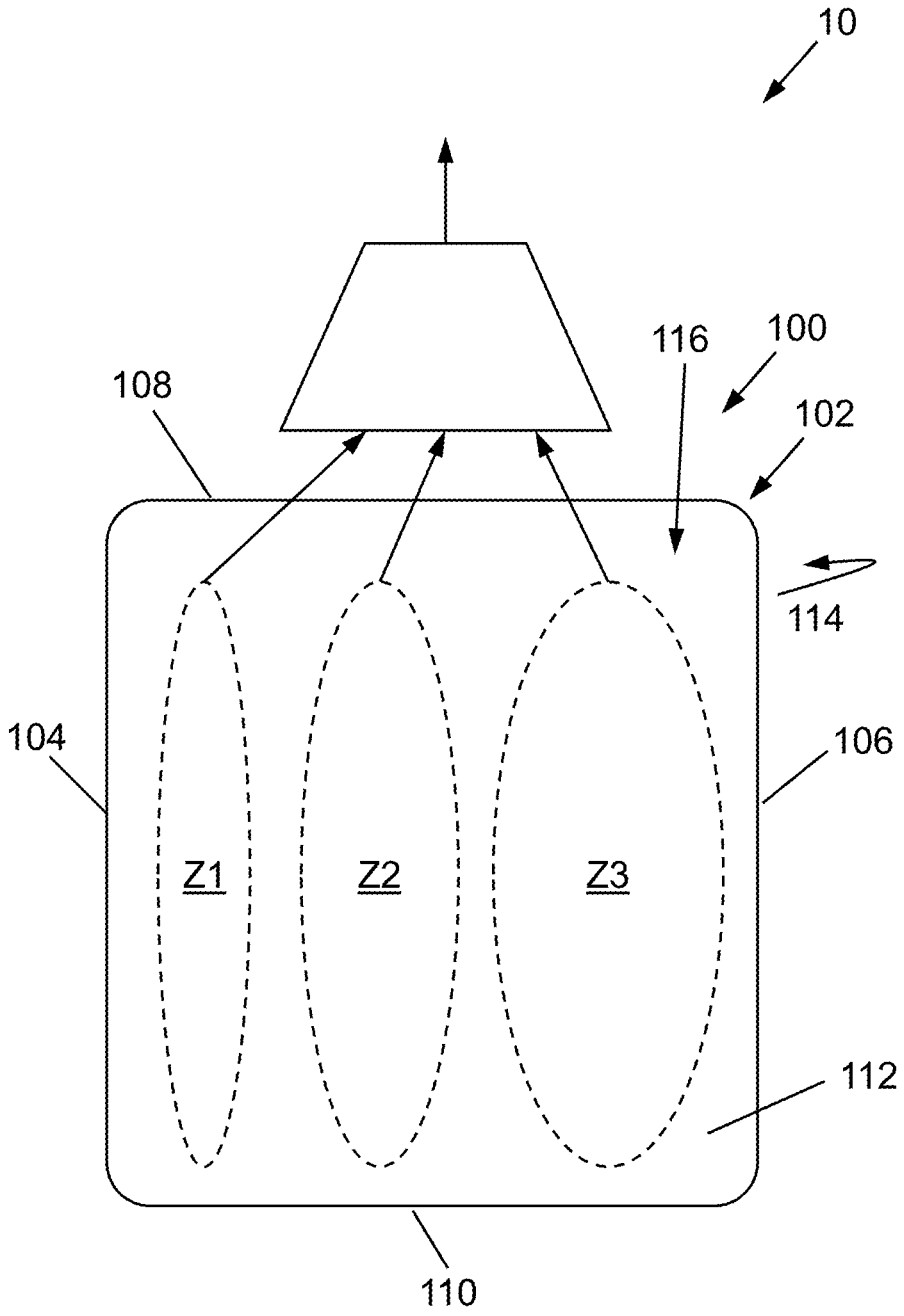
FIG. 5 shows a side view block diagram of a squeeze bottle system according to exemplary embodiments hereof.

In some embodiments, as shown in FIG. 5, the bottle assembly 100 also may include one or more squeeze zones Z1, Z2, Z3, . . . . Zn (individually and collectively Z) that when squeezed may cause the fluid to be ejected out the fluid output assembly 200 at a desired velocity. For example, if the bottle assembly 100 is squeezed at zone Z1, the fluid may flow out of the fluid output assembly 200 at a first velocity v1, if the bottle assembly 100 is squeezed at zone Z2, the fluid may flow out of the fluid output assembly 200 at a second velocity v2, and if the bottle assembly 100 is squeezed at zone Z3, the fluid may flow out of the fluid output assembly 200 at a third velocity v3. While the squeeze zones Z are depicted generally as oval shaped, it is understood that this is for demonstration and the squeeze zones Z may be of any shape or form. In some embodiments as will be described in other sections, the bottle system 10 also may include a tip assembly 300.

For the purposes of this specification, the squeeze bottle system 10 will be described primarily with respect to its use for delivering a fluid to for personal care purposes, however, it is understood that the squeeze bottle system 10 may be used for any applications that may benefit from the squeeze bottle system 10, and that the scope of the squeeze bottle system 10 is not limited in any way by the application for which it may be used. It also is understood that while the squeeze bottle system 10 may be described primarily as a handheld device, the system 10 may be any size, shape, or form.

In some embodiments, as shown in FIG. 5, the system's bottle assembly 100 includes an outer shell or housing 102 including a left side 104, a right side 106, a top 108, a bottom 110, a front side 112, and a back side 114 thereby defining an inner volume 116. While the housing 102 viewed from the front side 112 in FIG. 5 is depicted as generally rectangular in shape, it is understood that this is for demonstration and that the housing 102 may include any shape(s) and/or form(s), e.g., egg-shaped, tubular, etc.

In some embodiments, the bottle assembly 100 may include one or more (and preferably two or more) separate and generally distinct internal fluid passageways or channels through which the fluid may flow as it travels through the system 10 and out the fluid output assembly 200 as a fluid stream. In some embodiments, each individual fluid passageway may include one or more characteristics that may affect the fluid's output velocity, e.g., each individual fluid passageway may include a unique and distinct cross-sectional area that may influence the fluid pressure and fluid velocity as the fluid travels through the passageway.

Figure 6:
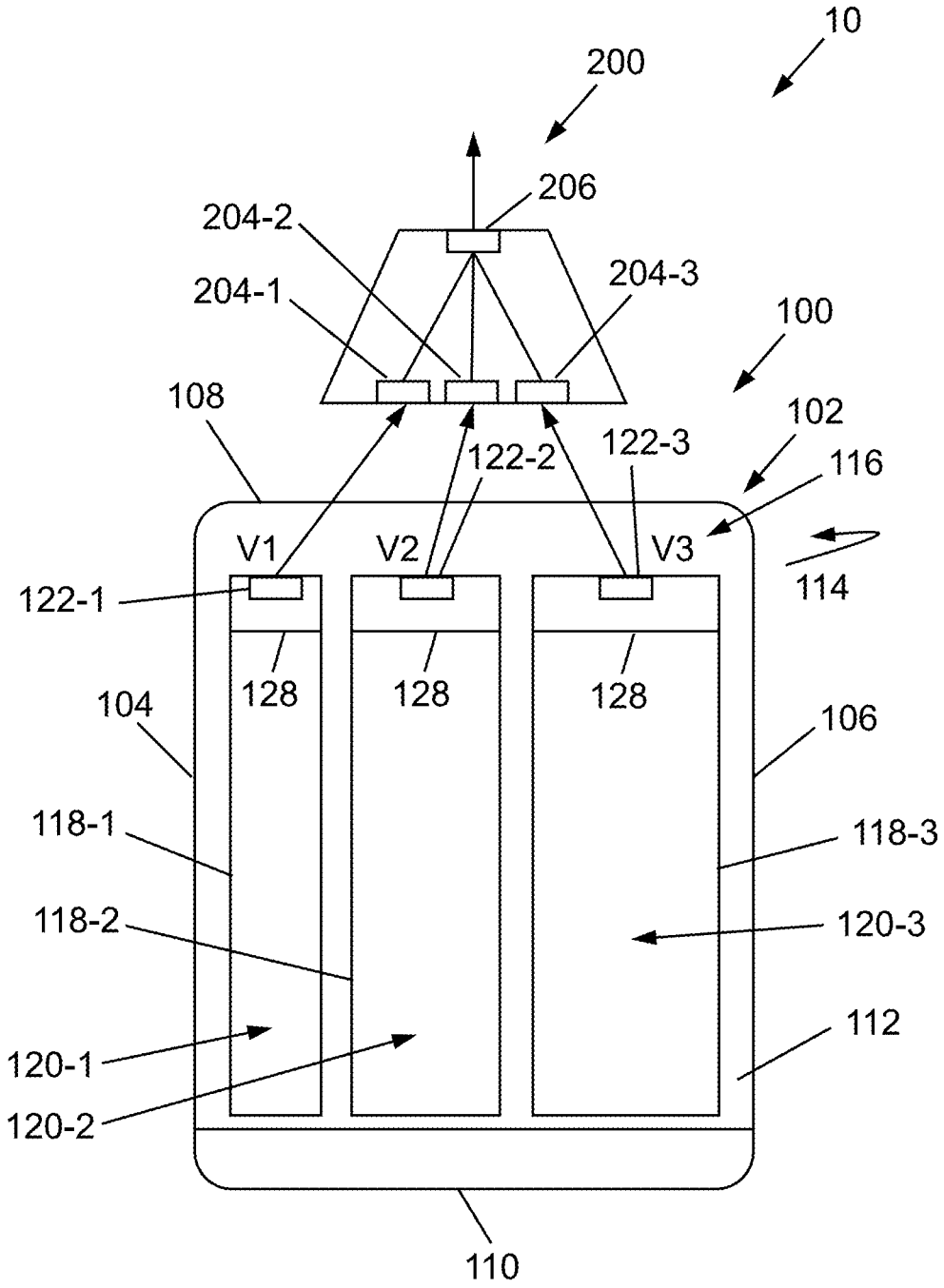
FIG. 6 shows a side view block diagram of a squeeze bottle system according to exemplary embodiments hereof.
Figure 7:
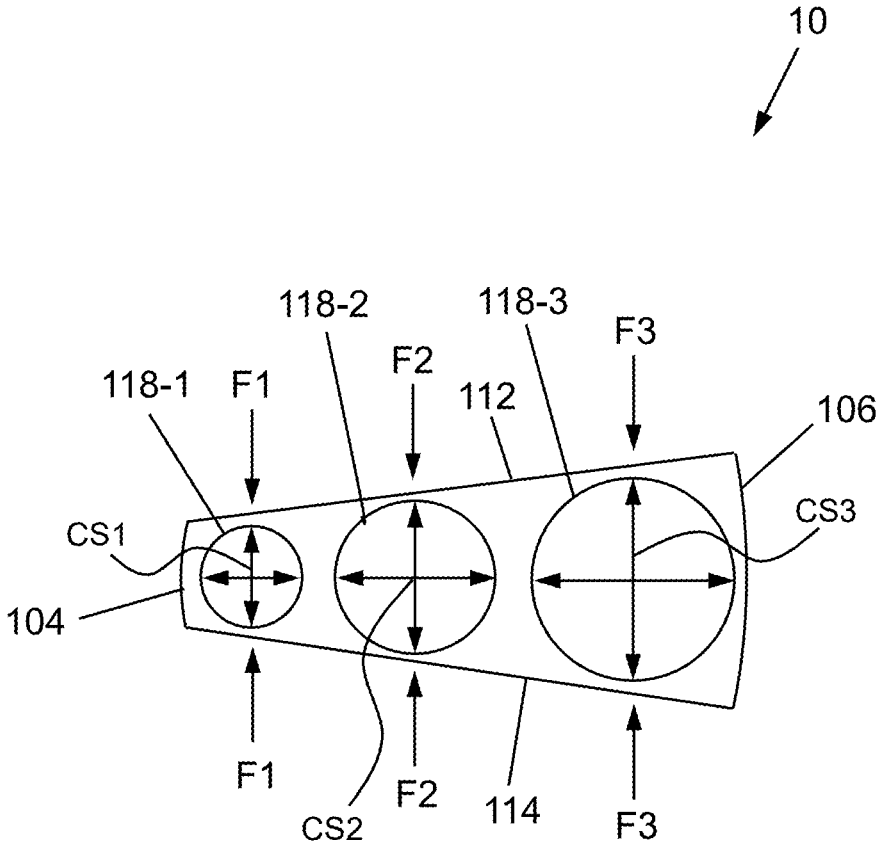
FIG. 7 shows a bottom view block diagram of a squeeze bottle system according to exemplary embodiments hereof.

FIG. 6 shows a side view block diagram of the system 10 and FIG. 7 shows a corresponding bottom view block diagram of the same.

In some embodiments, as shown in FIGS. 6 and 7, the bottle assembly 100 may include one or more (and preferably two or more) internal fluid chambers 118-1, 118-2, 118-3, . . . **118-*n* (individually and collectively 118). Each fluid chamber 118-1, 118-2, 118-3 may include a corresponding fluid chamber inner volume 120-1, 120-2, 120-3 and a corresponding cross-sectional area CS1, CS2, CS3, respectively. In addition, the first fluid chamber 118-1 may generally correspond in position to the first squeeze zone Z1, the second fluid chamber 118-2 may generally correspond in position to the second squeeze zone Z2, and the third fluid chamber 118-3 may generally correspond in position to the third squeeze zone Z3. That is, when a user squeezes the bottle 102 in the area of the first squeeze zone Z1, the first internal fluid chamber 118-1 also may be squeezed thereby applying an outside force F1 to the chamber 118-1 that may deform the chamber 118-1. Similarly, when a user squeezes the bottle 102 in the area of the second squeeze zone Z2, the second internal fluid chamber 118-2 also may be squeezed thereby applying an outside force F2 to the chamber 118-2 that may deform the chamber 118-2, and when a user squeezes the bottle 102 in the area of the third squeeze zone Z3, the third internal fluid chamber 118-3 also may be squeezed thereby applying an outside force F3 to the chamber 118-3 that may deform the chamber 118-3. While the internal fluid chambers 118 of FIGS. 6 and 3 are shown as generally tubular structures with generally circular cross-sectional shapes, it is understood that this is for demonstration and that the internal fluid chambers 118 may include any shape(s) and/or form(s). In addition, while the internal fluid chambers 118-1, 118-2, 118-3 are depicted as being side-by-side sequentially, it is understood that the chambers 118-1, 118-2, 118-3** may be arranged in other order(s) and in other configurations relative to one another.

In some embodiments, each chamber 118 may include a fluid output port 122 through which fluid held within the inner volume 120 of the associated chamber 118 may flow when caused to do so. As mentioned in other sections, the velocity of the fluid out the first chamber's fluid output port 122-1 may be designated v1, the velocity of the fluid out the second chamber's fluid output port 122-2 may be designated v2, and the velocity of the fluid out the third chamber's fluid output port 122-3 may be designated v3. In addition, for the purposes of this specification, the characteristics of each of the chambers' output fluid ports 122 may be the same in regard to their cross-sectional area and form such that each of the output ports 122 may affect the fluid similarly.

In some embodiments, the first chamber's cross-sectional area CS1 is smaller than the second chamber's cross-sectional area CS2 which is smaller than the third chamber's cross-sectional area CS3, i.e., CS1<CS2<CS3.

In some embodiments, each internal fluid chamber 118 is a self-contained fluid chamber separate and distinct from the other internal fluid chambers 118 with no fluid communication between the chambers 118 within the bottle's housing 102. As such, each individual fluid chamber 118 may be filled with a fluid that may be ejected from the chamber 118 through the chamber's output fluid port 122 upon a user squeezing the squeeze zone Z associated with the chamber 118. Accordingly, it may be preferable that each chamber 118 be fluid tight (with the exception of each chamber's fluid output port 122).

As is known in the art of fluid dynamics, the principle of continuity for incompressible fluids (based on the principle of conservation of mass) states that the product of the cross-sectional area CS of a chamber and the velocity v of the fluid at any point in the system is a constant.

Applying this to the current invention and comparing the first fluid chamber 118-1 and the second fluid chamber 118-2 results in:

$$(CS1)(v1) = (CS2)(v2)$$

Given the above, in some embodiments, because the first chamber's cross sectional area CS1 may be smaller than the second chamber's cross sectional area CS2, squeezing the first chamber 118-1 (e.g., by squeezing the bottle 102 at the first squeeze zone Z1) may result in a higher velocity v1 output of fluid out the first chamber's fluid output port 122-1 compared to the velocity v2 of fluid out the second chamber's fluid output port 122-2 given the same magnitude squeeze force F applied to the second fluid chamber 118-2 via the second squeeze zone Z2.

Similarly, in some embodiments, because the second chamber's cross sectional area CS2 may be smaller than the third chamber's cross sectional area CS3, squeezing the second chamber 118-2 (e.g., by squeezing the bottle 102 at the second squeeze zone Z2) may result in a higher velocity v2 output of fluid out the second chamber's fluid output port 122-2 compared to the velocity v3 of fluid out the third chamber's fluid output port 122-3 given the same magnitude squeeze force F applied to the third fluid chamber 118-3 via the third squeeze zone Z3.

Given the above, in some embodiments, for the same magnitude force F applied to each of the fluid chambers 118 via each respective squeeze zone Z, v1>v2>v3.

In some embodiments, as shown in FIG. 6, fluid output assembly 200 may include a housing 202 with one or more fluid input ports 204 and one or more (and preferably only one) output ports 206. In some embodiments, the fluid output assembly 200 includes at least one fluid input port 204 corresponding to each of the bottle's internal chamber's output ports 122-1, 122-2, 122-3. As such, fluid exiting the first fluid chamber 118-1 via the first fluid output port 122-1 may enter into the fluid output assembly 200 via its first fluid input port 204-1, fluid exiting the second fluid chamber 118-2 via the second fluid output port 122-2 may enter into the fluid output assembly 200 via its second fluid input port 204-2, and fluid exiting the third fluid chamber 118-3 via the third fluid output port 122-3 may enter into the fluid output assembly 200 via its third fluid input port 204-3. It is understood that each of the bottle's internal chamber's output ports 122-1, 122-2, 122-3 may be integrated into each of the corresponding fluid output assembly's input ports 204-1, 204-2, 204-3 such that each combined output port 122 and corresponding input port 204 may be a single mechanism.

In some embodiments, as shown in FIG. 6, the fluid output assembly 200 may combine the fluid entering into the assembly 200 (from any of the fluid input ports 204-1, 204-2, 204-3) into a single output fluid stream that may exit the fluid output assembly 200 via the assembly's fluid output port 206.

Given the above, if a user squeezes the bottle assembly 200 at multiple squeeze zones Z simultaneously, each internal fluid chamber 118 associated with a squeeze zone Z being squeezed may contribute fluid into the fluid output assembly 200 at its corresponding fluid velocity. The fluid from each squeezed chamber 118 may be combined together within the fluid output assembly 200 and output the assembly's fluid output port 206 at a corresponding combined fluid velocity. It also is appreciated that each internal fluid chamber 118 may contain a different fluid than the fluid(s) that the other fluid chambers 118 may contain such that the fluids may be delivered independent of one another (e.g., by squeezing a single squeeze zone Z) or in combination (e.g., by squeezing two or more squeeze zones Z simultaneously. In addition, each of the internal fluid chambers 118 and/or the overall system housing 102 may include an air intake valve as necessary to relieve any vacuums that may form within the system 10 during its use.

FIG. 7 shows a bottom view block diagram of the bottle assembly 100. In this drawing, the cross-sectional areas CS of the internal fluid chambers 118 are depicted as circular. However, it is understood that this is for demonstration and that the cross-sectional areas CS of the internal fluid chambers 118 may be any shape or form. As shown, in some embodiments, the first chamber's cross-sectional area CS1 is smaller than the second chamber's cross-sectional area CS2 which is smaller than the third chamber's cross-sectional area CS3, i.e., CS1<CS2<CS3.

Figure 8:
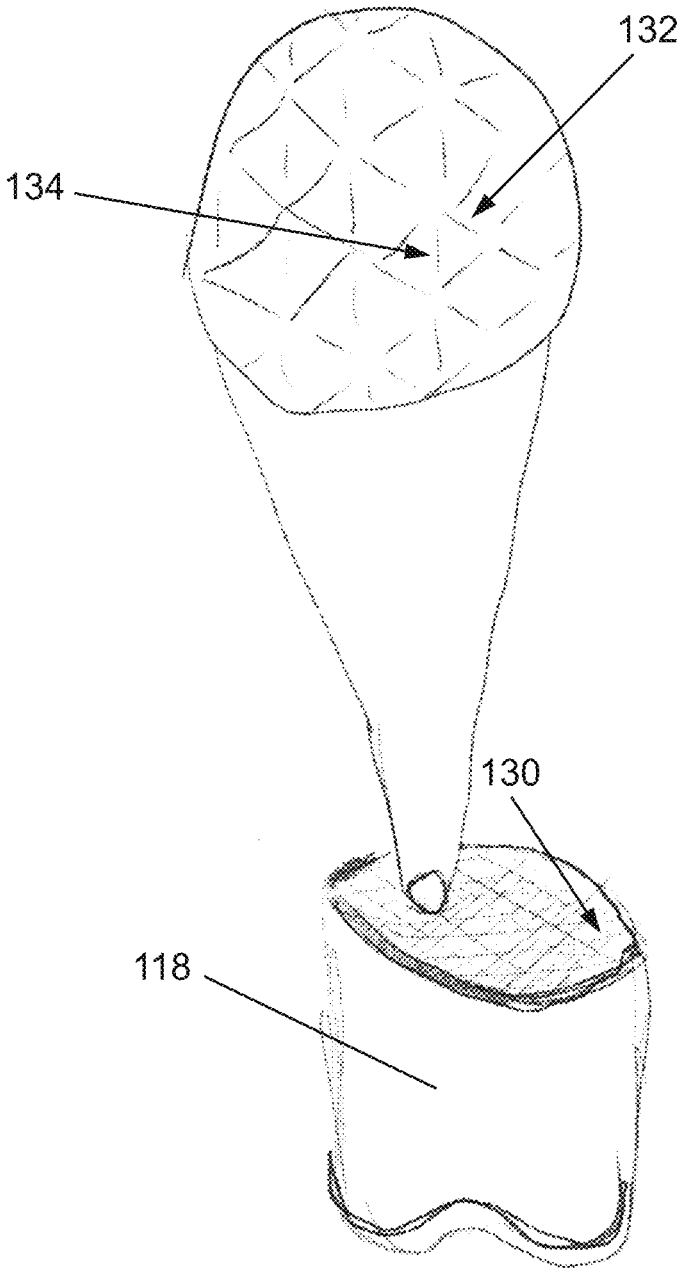
FIG. 8 shows aspects of a fluid chamber according to exemplary embodiments hereof.

FIG. 8 shows a generalized view of a portion of an internal fluid chamber 118 with the inner sidewalls exposed for discussion.

In some embodiments, as shown in FIG. 8, the internal fluid chambers 118 may include inner sidewalls 130, and the inner sidewalls 130 may include surface textures 132. In some embodiments, the surface textures 132 may include wrinkles and/or dimples 134 that include raised portions (e.g., upward sloping concave surfaces) joined at intersections with recessed portions (e.g., downward sloping concave surfaces).

In some embodiments, the surface texture 132, e.g., the dimples 134, may provide several benefits to the system 10. First, the dimples 134, by adding irregular surface portions with raised and recessed intersections therebetween, may cause the fluid flowing past the sidewalls 130 to experience additional turbulence and/or vortices about the irregularities which may further mix the fluid. The surface texture 132, e.g., the dimples 134, also may introduce increased friction between the fluid and the inner sidewalls 130 thereby contributing to a more efficient flow and potentially a drop in fluid pressure. The dimples 134 also may increase the effective surface area provided by the inner sidewalls 130.

As is known in fluid dynamics, Bernoulli's principle states that fluid velocity and fluid pressure are inversely proportional. Applying this while taking into account the above-described inner surface textures 132 (e.g., dimples), the increased turbulence and potential pressure drop of the fluid may result in an increased fluid velocity thereby improving the efficiency of the fluid chamber 118 output. It is understood that the inner sidewalls 130 also may include any types of suitable textures including but not limited to wrinkles, dimples, bumps, ridges, grooves, raised portions, recessed portions, other types of textures, and/or any combinations thereof. It also is understood that the textures 132 may be random, patterned (e.g., linear, circular, following other geometries, etc.), and/or in any combinations thereof.

Figure 9:
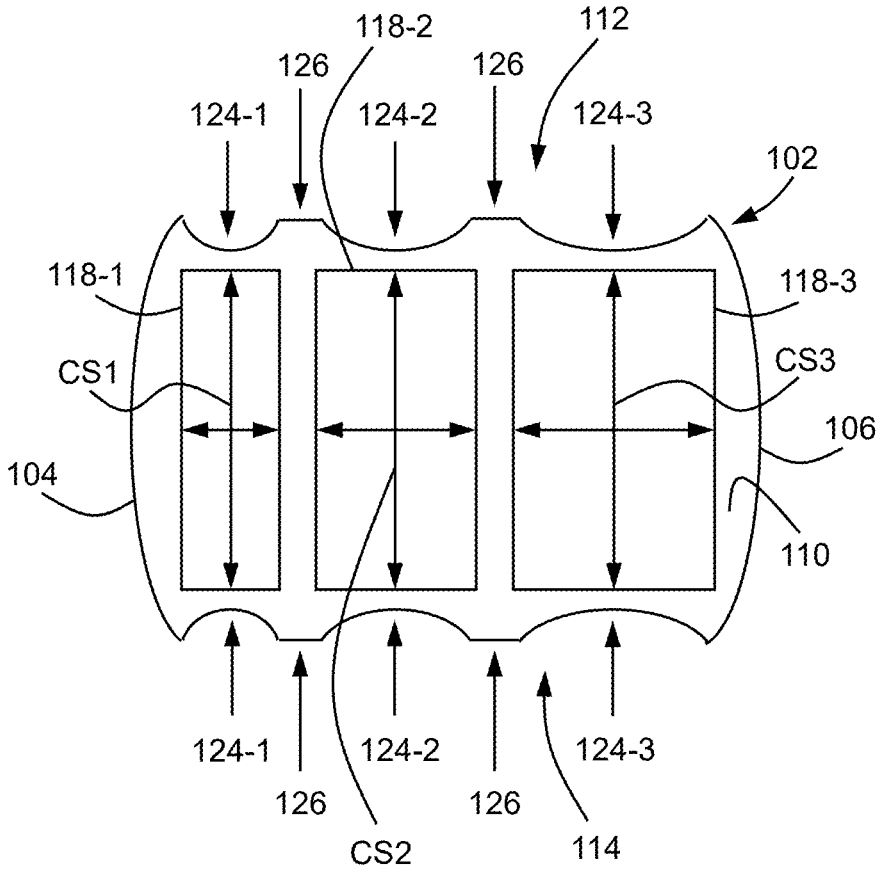
FIG. 9 shows a bottom view block diagram of a squeeze bottle system according to exemplary embodiments hereof.

In some embodiments, as shown in FIG. 9, the bottle housing 102 may include one or more recesses 124 or other types of identifiable characteristics or elements (e.g., surface texturing, insignia, etc.), with each recess 124 positioned at a location corresponding to a respective squeeze zone Z. As such, each pair of opposing recesses 124 may provide visual and structural guidance to a user showing where to grasp the bottle 102 when a particular squeeze zone Z (and a resulting fluid velocity corresponding to the squeeze zone Z) is desired. For example, a user may grasp the bottle 102 between his/her forefinger and thumb at opposing recesses 124-1 (upper and lower in FIG. 9) to squeeze the bottle 102 (and the corresponding internal fluid chamber 118-1) at the first squeeze zone Z1, at opposing recesses 124-2 (upper and lower in FIG. 9) to squeeze the bottle 102 (and the corresponding internal fluid chamber 118-2) at the first squeeze zone Z2, and/or at opposing recesses 124-3 (upper and lower in FIG. 9) to squeeze the bottle 102 (and the corresponding internal fluid chamber 118-3) at the first squeeze zone Z3.

In some embodiments, the housing 102 may include one or more separation areas 126 preferably positioned between each squeeze zone Z (and/or between each respective recess 124). In some embodiments, the recesses 124 and the separation areas 126 may preferably extend side-by-side along the sides of the bottle housing 102 (e.g., along the front 112 and/or the back 114 of the bottle 102) from (or close to) the top 108 of the housing 102 to (or close to) the bottom 110 of the housing 102, and/or along any portion(s) thereof.

In some embodiments, the recesses 124 may preferably comprise a flexible material (e.g., a soft polypropylene) such that the recesses 124 may be squeezed, and the separation areas 126 between the recesses 124 may preferably comprise a more stiff or rigid material (e.g., a higher durometer rubber or plastic). In some embodiments, the separation areas 126 may mechanically isolate the squeeze zones Z (and the corresponding recesses 124) from one another such that squeezing one zone Z may not cause the other un-squeezed zones Z to be affected. As such, only the intentionally squeezed zone Z may provide fluid output while the un-squeezed zones Z may not. The separation areas 126 also may include ribs, greater thicknesses of material, dampening mechanism such as air pockets in the material, and/or other elements to provide the mechanical isolation.

In some embodiments, as shown in FIG. 6, each fluid chamber's fluid output port 122 may include a one-way valve 128 that may allow fluid to flow from the corresponding fluid chamber 118 out the fluid output port 122 and into the fluid output assembly 200, but not from outside the fluid output port 122 (e.g., not from the fluid output assembly 200) into the corresponding fluid chamber 118. In some embodiments, the one-way valves 128 may include mechanical one-way valves 128 that activates when the fluid applies a force to the input of the valve 128. For example, when the user squeezes a particular squeeze zone Z associated with a particular internal fluid chamber 118, the fluid within the chamber 118 may press against the one-way valve 128 causing it to open and to allow the fluid to pass through. The valve 128 may then close when the squeezing action ceases. Such a one-way valve 128 may include a duckbill valve and/or other suitable types of one-way valves.

In some embodiments, the fluid output assembly 200 may enable a user to choose which internal fluid chamber(s) 118 to allow fluid to flow from. For example, the fluid output chamber 200 may include a control mechanism that may open one or more fluid input ports 204 while closing the other input ports 204. In this way, the open fluid input ports 204 may allow fluid to flow when the associated squeezing zone(s) Z are squeezed while the closed fluid input ports 204 may disallow fluid flow regardless of which squeeze zone Z is squeezed. For example, in some embodiments, the fluid output assembly 200 may be rotatable about the longitudinal axis of the bottle 102 (defined by the bottle's topside 108 and its bottom side 110) to open and/or close one or more fluid input ports 204-1.

Figure 10:
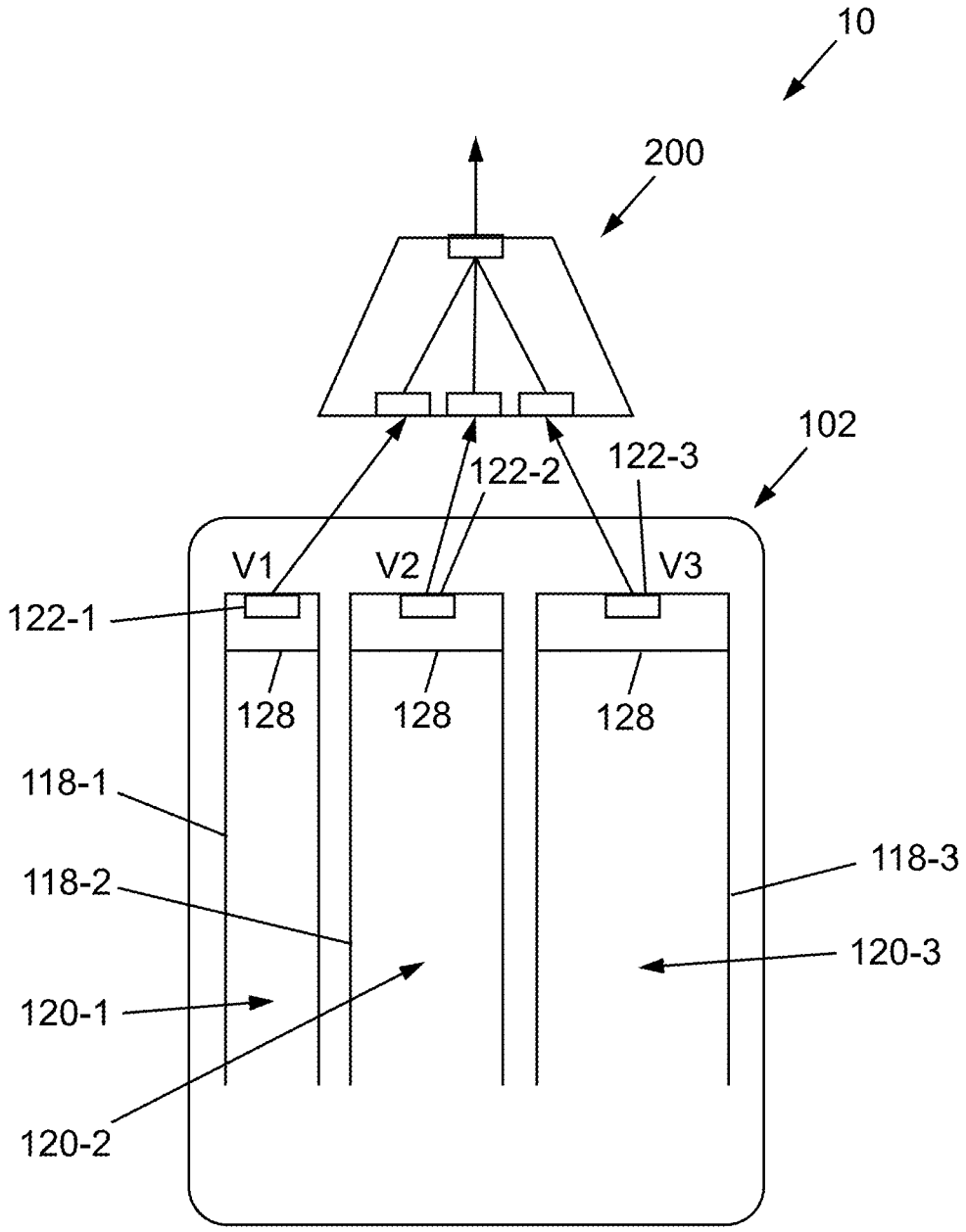
FIG. 10 shows a side view block diagram of a squeeze bottle system according to exemplary embodiments hereof.

In some embodiments, as shown in FIG. 10, the inner volumes 120 of the internal fluid chambers 118 may be in fluid communication with one another and/or with the inner volume 116 of the overall bottle housing 102. In this way, the inner volume 116 of the bottle 102 may be filled with a fluid which may in turn fill each respective inner volume 120 of each internal fluid chamber 118.

In some embodiments, squeezing a particular squeeze zone Z may preferably only cause fluid within the corresponding internal fluid chamber 118 to be forced out the fluid chamber's fluid output port 122, while not causing fluid to be forced out of the other internal fluid chambers 118 associated with the un-squeezed squeeze zones Z. For example, the separation areas 126 may adequately isolate the un-squeezed fluid chambers 118 from the squeezed fluid chambers 118 such that their associated internal fluid chambers 118 may not be affected during the squeezing motion. In another example, the fluid path between a squeezed internal fluid chamber 118 and its neighboring internal fluid chamber(s) 118 may include an adequate amount of resistance such that fluid within the squeezed internal fluid chamber 118 may not flow into the neighboring chambers 118 when squeezed, and instead, may only (or at least substantially only) flow out through the squeezed chamber's fluid output port 122.

In some embodiments, the one-way valves 128 may be designed to open when a squeezing motion is applied to the one-way valve 128 itself and/or to its respective internal chamber 118 and/or squeeze zone Z. In this case, it may be preferable that the one-way valve 128 only open when such a force F is applied. For example, the one-way valve 128 may open when it is squeezed on opposite sides. In this scenario, squeezing a particular squeeze zone Z may apply a force F to the one-way valve 128 itself thereby causing the valve 128 open. To be clear, in these embodiments, the one-way valves 128 may preferably not be designed to open upon the fluid applying a force to the input to the valve 128, but instead, the valve 128 may be mechanically opened only by the force F applied to the valve 128 by the squeezing motion. In this way, when a user may squeeze a particular squeeze zone Z corresponding to a particular internal fluid chamber 118, the particular fluid chamber's one-way valve 128 may be caused to open (due to the squeezing force F itself) while the other one-way valves 128 associated with the other internal fluid chambers 118 may not open because they may not receive the necessary mechanical force F. In addition, even though fluid may press against these inactive one-way valves 128 (because the chambers 118 may be in fluid communication), fluid may not flow out the inactive valves 128 because the valves 128 may remain closed. As such, fluid may be caused to eject out of the squeezed fluid chamber's output port 122 at the desired fluid velocity that may correspond to the respective fluid chamber's cross-sectional area CS.

In some embodiments, each squeeze zone Z may be mechanically linked to its respective one-way valve 128 via ribs, sections of more rigid or thicker material, or by other force-applying structures generally mechanically joining the squeeze zone Z and its one-way valve 128. In this way, when the squeeze zone Z is squeezed, an adequate force also may be applied to the one-way valve 128 thereby causing the valve 128 to open.

Figure 11:
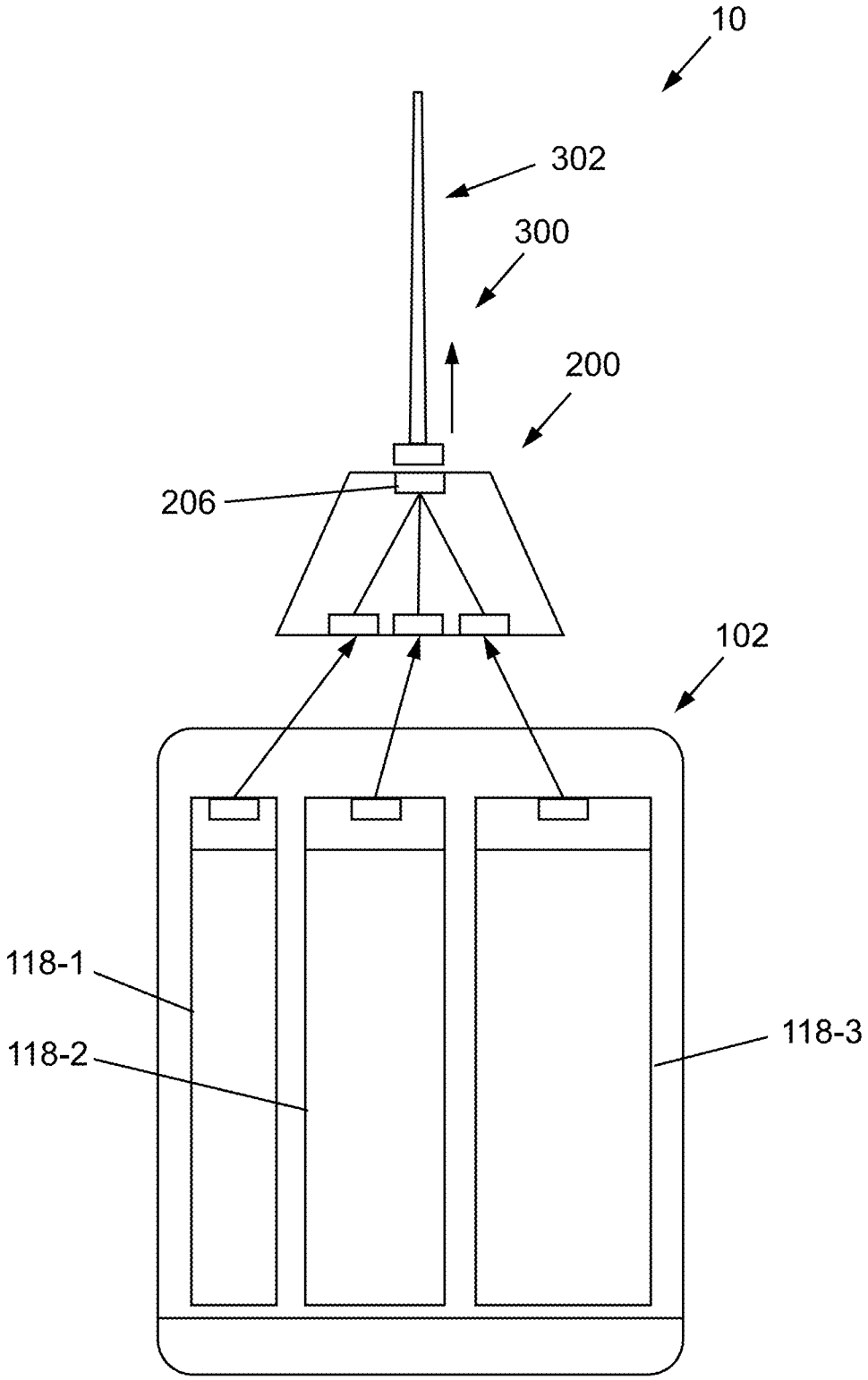
FIG. 11 shows a side view block diagram of a squeeze bottle system according to exemplary embodiments hereof.

In some embodiments, as shown in FIG. 11, the bottle system 10 may include a tip assembly 300 configured with the fluid output port 206 of the fluid output assembly 200. In general, the tip assembly 300 may tailor the form and structure of the fluid output from the overall system 10 for specific applications. For example, the tip assembly 300 may be designed to provide a thin stream of fluid output, a laminar stream of fluid output, a mist, a dispersed output (e.g., 360° dispersion), and/or other types of fluid outputs. In addition, depending on which squeeze zone Z is squeezed and which corresponding internal fluid chamber 118 is caused to provide fluid to the tip assembly 300, the tip assembly 300 may provide the output fluid at a particular velocity.

In some embodiments, the tip assembly 300 may include a tip member 302 designed to affect the fluid output in a particular way. For example, as shown in FIG. 11, the tip member 302 may be a nozzle that provides an output fluid stream. The tip member 302 may include an output cross-sectional shape that may be chosen to determine the characteristics of the fluid stream, e.g., circular, oval shaped, slot shaped, multiple output holes for a shower effect, other forms of nozzles, and/or any combinations thereof.

In some embodiments, the tip assembly 300 may be a permanent attachment to the output fluid assembly 200 and/or in other embodiments the tip assembly 300 may be replaceable and/or interchangeable (e.g., screw on). When permanent, the tip assembly 300 may be adjustable to provide a multitude of different fluid output forms (steams, mists, etc.) depending on the desired use.

In some embodiments, as shown in FIG. 12, the tip member 302 may include a canula 316. The cannula 316 may correspond to the elongate tip member 302 of FIGS. 1-3.

The canula 316 may include an elongate body with an inner volume 310 through which the fluid may flow and one or more side openings 314 in its side walls 308 through which the fluid may exit the canula 316 when fluid under pressure passes through the canula 316, e.g., from the fluid output assembly 200. The canula 316 may comprise plastic (e.g., flexible, rigid, semi-rigid, etc.), rubber, metal, and/or other suitable materials. In addition, it may be preferable that the cannula 316 be bendable with memory such that it may be bent into a desired curvature and may generally remain in the desired curvature until intentionally changed.

In some embodiments, the canula 316 may include an anti-drip element. For example, in some embodiments, the canula 316 may include a thin coating or sheath 318 (e.g., a thin rubber coating) that covers at least a portion of its outer surface 308 including the canula's side openings 314. For clarity, the sheath 318 is only shown on one side of the sectional view of the canula body 316 but it is understood that the sheath 318 may cover the entire outer surface area (or any portion thereof) of the canula 316.

In addition, in some embodiments, the outer sheath 318 may include one or more slits 320 (e.g., punctures) passing entirely through the sheath 318 at locations that correspond in position with each side opening 314 on the canula 316. It may be preferable that there is a one-to-one correspondence between the canula's side openings 314 and the sheath's slits 320 with each side opening 314 being generally covered by a corresponding slit 320.

FIG. 13 shows a close-up side view of the canula 316, a side opening 314, the outer sheath 318, and a corresponding sheath slit 320 in a closed configuration, and FIG. 9B shows the same but with the sheath slit 320 in an open configuration.

In some embodiments, the sheath 318 may comprise a rubber, a polymer, and/or other materials that may be flexible with adequate elasticity and mechanical memory such that the sheath may flex when a force is applied and may return to its original form when the force is removed.

In some embodiments, as shown in FIG. 9A, when no fluid is flowing under pressure through the canula 316, the slit 320 in the sheath 318 remains closed and may disallow any residual fluid within the sheath body 318 from exiting the canula 316 via the corresponding side opening 314. However, as shown in FIG. 9B, when a fluid under pressure passes through the canula 316, the fluid may exit through the side opening 314 and apply a force to the sheath slit 320 at the output of the side opening 314 that may force the slit 320 to bend open and allow the fluid to pass through. When this happens, the canula 316 may generally perform as customarily expected by providing individual output streams of fluid through each side opening 314 and corresponding opened slit 320.

Then, when the fluid under pressure within the canula 316 ceases (i.e., the user stops squeezing the bottle housing 102), the force may be removed from the slit material and the slit 320 may return to its original closed form. This may in turn close off (e.g., seal) the output of the side opening 314 thereby preventing residual fluid (e.g., fluid within the canula but not necessarily under pressure or at a lesser pressure) to remain within the canula 316. In this way, the canula 316 may be drip free. In some embodiments, the thickness of the sheath 318 may be about 0.1 mm to about 2.0 mm. The sheath 318 may be applied to the canula 316 via dipping, spraying, brushing, misting, using other techniques, and/or by any combinations thereof. The slits 320 may then be cut by mechanical mechanisms such as blades, by laser cutting, by other cutting techniques, and/or by any combinations thereof.

In some embodiments, the cannula 316 may include the integrated brush 400 with bristles 402 as described in relation to FIGS. 2-4. The bristles may comprise soft flexible polymers or other materials that may provide interdental cleaning between teeth and along the gum line. It may be preferable that when contour or curvature of the canula 316 is adjusted (e.g., bent into a desirable curvature) that the bristle profile(s) 404 and the angles of the aggregate bristles 402 also may be adjustable. It also may be preferable that the canula 316 be rotatable about the longitudinal axis of the bottle 302 such that the bristles 402 also may be adjusted rotationally. In this way, the canula 316 and its associated bristles 402 may act as an adjustable interdental brush.

It is understood that any aspects or elements of any of the embodiments of the stabilization assembly 10 may be combined with any other aspects or elements of any other embodiments of the stabilization assembly 10 to form additional embodiments of the stabilization assembly 10 that also are within the scope of the stabilization assembly 10.

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A squeeze bottle system comprising:

a squeeze bottle adapted to contain a fluid;

a fluid output tip in fluid communication with the squeeze bottle, the fluid output tip including an elongate body with sidewalls;

a plurality of brush bristles configured with the elongate body sidewalls;

at least one opening in the elongate body sidewalls in an area of the plurality of brush bristles, the at least one opening configured to allow the fluid to move from within the squeeze bottle to outside the fluid output tip at the at least one opening when the squeeze bottle is squeezed;

wherein the plurality of bristles cover an entire circumference of a portion of the elongate body in an area that includes at least one of the at least one opening, and wherein at least one of the plurality of bristles extends across at least one of the at least one openings and is adapted to be wetted by the fluid when the squeeze bottle is squeezed.

2. The squeeze bottle system of claim 1 wherein the fluid output tip includes a longitudinal length and the at least one brush bristle includes a plurality of brush bristles that cover at least a portion of the fluid output tip's longitudinal length.

3. The squeeze bottle system of claim 2 wherein the at least a portion of the fluid output tip's longitudinal length includes at least 50% of the fluid output tip's longitudinal length.

4. The squeeze bottle system of claim 2 wherein the plurality of brush bristles forms a brush diameter and wherein the brush diameter is constant along the portion of the fluid output tip's longitudinal length covered by the plurality of brush bristles.

5. The squeeze bottle system of claim 1 wherein the at least one opening includes at least 40 side openings.

6. The squeeze bottle system of claim 1 further comprising a sheath configured to cover the at least one opening.

7. The squeeze bottle system of claim 6 wherein the sheath includes a slit aligned with the at least one opening, the slit adapted to open under a pressure from the fluid moving from within the squeeze bottle to outside the fluid output tip when the squeeze bottle is squeezed.

8. The squeeze bottle system of claim 7 wherein the slit is adapted to close when the pressure ceases.

9. The squeeze bottle system of claim 6 wherein the sheath comprises a flexible material.

10. A squeeze bottle system comprising:

a squeeze bottle adapted to contain a fluid;

a fluid output tip in fluid communication with the squeeze bottle, the fluid output tip including an elongate body with sidewalls;

a plurality of brush bristles configured with the elongate body sidewalls;

at least one opening in the elongate body sidewalls in an area of the plurality of brush bristles, the at least one opening configured to allow the fluid to move from within the squeeze bottle to outside the fluid output tip at the at least one opening when the squeeze bottle is squeezed;

a first inner fluid compartment within the squeeze bottle and corresponding to a first side location of the squeeze bottle and including a first cross-sectional area, the first inner fluid compartment adapted to contain a first portion of the fluid; and a second inner fluid compartment within the squeeze bottle and corresponding to a second side location of the squeeze bottle and including a second cross-sectional area different than the first cross-sectional area, the second inner fluid compartment adapted to contain a second portion of the fluid;

wherein when the squeeze bottle is squeezed at the first side location, a portion of the first portion of the fluid is caused to move from within the first inner fluid compartment to outside the fluid output tip via the at least one opening and at a first velocity dependent at least in part on the first cross-sectional area;

wherein when the squeeze bottle is squeezed at the second side location, a portion of the second portion of the fluid is caused to move from within the second inner fluid compartment to outside the fluid output tip via the at least one opening and at a second velocity different than the first velocity and dependent at least in part on the second cross-sectional area.

11. The squeeze bottle system of claim 10 wherein the first inner fluid compartment includes a first compartment output leading to the fluid output tip and configured with a first one-way valve, and the second inner fluid compartment includes a second compartment output leading to the fluid output tip and configured with a second one-way valve.

12. The squeeze bottle system of claim 10 wherein the first and second inner fluid compartments are not in fluid communication with one another.

13. The squeeze bottle system of claim 10 wherein the first inner fluid compartment includes a first inner sidewall that includes at least one first dimple, and/or the second inner fluid compartment includes a second inner sidewall that includes at least one second dimple.

14. A squeeze bottle system comprising:

a squeeze bottle adapted to contain a fluid;

a fluid output tip in fluid communication with the squeeze bottle, the fluid output tip including an elongate body with sidewalls;

a plurality of brush bristles configured with the elongate body sidewalls;

at least one opening in the elongate body sidewalls in an area of the plurality of brush bristles, the at least one opening configured to allow the fluid to move from within the squeeze bottle to outside the fluid output tip at the at least one opening when the squeeze bottle is squeezed;

wherein the at least one opening includes a plurality of openings arranged about an outer circumference of the fluid output tip sidewalls to provide 360° of output fluid dispersion about a longitudinal axis of the fluid output tip, and wherein at least one of the plurality of bristles extends across at least one of the at least one openings and is adapted to be wetted by the fluid when the squeeze bottle is squeezed.

15. A squeeze bottle system comprising:

a squeeze bottle adapted to contain a fluid;

a fluid output tip in fluid communication with the squeeze bottle, the fluid output tip including an elongate body with sidewalls;

a plurality of brush bristles configured with the elongate body sidewalls;

at least one opening in the elongate body sidewalls in an area of the at least one brush bristle, the at least one opening configured to allow the fluid to move from within the squeeze bottle to outside the fluid output tip at the at least one opening when the squeeze bottle is squeezed;

a first inner fluid compartment within the squeeze bottle and corresponding to a first side location of the squeeze bottle, the first inner fluid compartment adapted to contain a first portion of the fluid; and a second inner fluid compartment within the squeeze bottle and corresponding to a second side location of the squeeze bottle, the second inner fluid compartment adapted to contain a second portion of the fluid;

wherein when the squeeze bottle is squeezed at the first side location, a portion of the first portion of the fluid is caused to move from within the first inner fluid compartment to outside the fluid output tip via the at least one opening;

wherein when the squeeze bottle is squeezed at the second side location, a portion of the second portion of the fluid is caused to move from within the second inner fluid compartment to outside the fluid output tip via the at least one opening;

wherein the first and second inner fluid compartments are in fluid communication with one another.

* * * * *